US010807768B2

(12) United States Patent
Kim

(10) Patent No.: US 10,807,768 B2
(45) Date of Patent: Oct. 20, 2020

(54) FIXING FRAME AND CAKE PACKAGING STRUCTURE INCLUDING THE FIXING FRAME

(71) Applicant: PARIS CROISSANT CO., LTD, Seongnam-si, Gyeonggi-do (KR)

(72) Inventor: Sun Young Kim, Seoul (KR)

(73) Assignee: PARIS CROISSANT CO., LTD, Seongnam-si, Gyeonggi-Do (KR)

( * ) Notice: Subject to any disclaimer, the term of this patent is extended or adjusted under 35 U.S.C. 154(b) by 79 days.

(21) Appl. No.: 16/223,840

(22) Filed: Dec. 18, 2018

(65) Prior Publication Data

US 2020/0024034 A1 Jan. 23, 2020

(30) Foreign Application Priority Data

Jul. 18, 2018 (KR) ..... 10-2018-0083619
Sep. 21, 2018 (KR) ..... 10-2018-0114079

(51) Int. Cl.
*B65D 25/10* (2006.01)
*B65D 85/36* (2006.01)
(Continued)

(52) U.S. Cl.
CPC ..... *B65D 25/108* (2013.01); *B65D 61/00* (2013.01); *B65D 81/052* (2013.01); *B65D 85/36* (2013.01);
(Continued)

(58) Field of Classification Search
CPC ..... B65D 25/10; B65D 25/108; B65D 61/00; B65D 81/05; B65D 81/052; B65D 81/18;
(Continued)

(56) References Cited

U.S. PATENT DOCUMENTS 2,784,895 A * 3/1957 Linwood, Jr. ..... B65D 5/5045 206/594
5,899,353 A 5/1999 Sabin et al.

FOREIGN PATENT DOCUMENTS

CN 201770175 U * 3/2011 ..... B65D 85/36
CN 202625005 U * 12/2012
(Continued)

OTHER PUBLICATIONS

Korean Office Action with English translation of Korean Application No. 10-2018-0083619; dated Sep. 6, 2018.
(Continued)

*Primary Examiner* — Bryon P Gehman
(74) *Attorney, Agent, or Firm* — Kile Park Reed & Houtteman PLLC

(57) ABSTRACT

A fixing frame includes an inner side portion having a shape corresponding to that of a side surface of a cake supported on a pedestal to be configured to support the side surface of the cake, an outer side portion having a shape corresponding to that of an inner side surface of a box for receiving the cake supported by the pedestal to be configured to support an inner side surface of the box and a connecting portion configured to connect an upper end of the inner side portion and an upper end of the outer side portion with each other. Thus, the fixing frame is to be provided between the side surface of the cake and the inner side surface of the box to support the side surface of the cake to prevent the cake from moving in the box.

18 Claims, 4 Drawing Sheets

(51) Int. Cl.
*B65D 81/05* (2006.01)
*B65D 61/00* (2006.01)

(52) U.S. Cl.
CPC .. *B65D 2581/055* (2013.01); *B65D 2585/363* (2013.01)

(58) Field of Classification Search
CPC ..... B65D 85/36; B65D 2581/055; B65D 2585/363; B65D 77/24; A47G 23/06
USPC ..... 206/488, 521, 523, 583–594
See application file for complete search history.

(56) References Cited

FOREIGN PATENT DOCUMENTS

| | | | | | |
|---|---|---|---|---|---|
| CN | 205615983 | U | * | 10/2016 | ..... B65D 85/36 |
| CN | 207417440 | U | * | 5/2018 | ..... B65D 25/10 |
| GB | 2218966 | A | * | 11/1989 | ..... B65D 85/36 |
| JP | 2000-289780 | | | 10/2000 | |
| JP | 2001-322629 | | | 11/2001 | |
| JP | 3179017 | U | * | 10/2012 | ..... B65D 85/36 |
| KR | 10-1531673 | B1 | * | 6/2015 | ..... B65D 5/50 |
| NL | 2006108 | C | * | 8/2012 | ..... B65D 85/36 |

OTHER PUBLICATIONS

Korean Office Action with English translation of Korean Application No. 10-2018-0114079; dated Oct. 15, 2018.

* cited by examiner

FIXING FRAME AND CAKE PACKAGING STRUCTURE INCLUDING THE FIXING FRAME

CROSS-REFERENCE TO RELATED APPLICATIONS

This application claims priority under 35 USC § 119 to Korean Patent Application Nos. 10-2018-0083619 filed on Jul. 18, 2018 and 10-2018-0114079 filed on Sep. 21, 2018 and the contents of which are herein incorporated by reference in its entirety.

BACKGROUND OF THE INVENTION

1. Field of the Invention

Example embodiments of the present invention relate to a fixing frame and a cake packaging structure having the same, and more particularly, to the fixing frame capable of stably fixing the cake for conveying or delivering the cake, and the cake packaging structure having the fixing frame.

2. Description of the Related Art

Generally, a cake is received in a box with being placed on a pedestal, and then the cake is delivered to a destination place.

When the cake is conveyed, the cake can be abnormally moved on the pedestal by a vibration or an impact. In order to solve this problem, a fixing member is provided at a central portion of an upper surface of the pedestal to prevent the cake from moving.

However, even if the fixing member is provided, the cake may move in the horizontal direction and be damaged in case when the vibration or the impact is applied considerably to the cake.

SUMMARY OF THE INVENTION

Example embodiments of the present invention provide a fixing frame capable of stably fixing a cake even in case that the cake is shaken or impacted while transported or delivered.

Example embodiments of the present invention provide a cake packaging structure including the fixing frame.

According to one aspect of the present invention, a fixing frame includes an inner side portion having a shape corresponding to that of a side surface of a cake supported on a pedestal to be configured to support the side surface of the cake, an outer side portion having a shape corresponding to that of an inner side surface of a box for receiving the cake supported by the pedestal to be configured to support an inner side surface of the box and a connecting portion configured to connect an upper end of the inner side portion and an upper end of the outer side portion with each other, wherein the fixing frame is to be provided between the side surface of the cake and the inner side surface of the box to support the side surface of the cake to prevent the cake from moving in the box.

In an example embodiment, the fixing frame may further include at least one holding groove being formed on the inner side portion or the outer side portion and extending vertically for easily inserting the fixing frame into the box and easily extracting the fixing frame from the box.

In an example embodiment, a least one of the inner side portion and the outer side portion may be inclined toward the other such that a plurality of fixing frames is vertically stacked with making entire contact with each other.

In an example embodiment, the fixing frame may include a plurality of fixing parts having a size identical to each other.

In an example embodiment, the fixing frame may further include a receiving groove formed along an upper side of the inner side portion, wherein in case that the cake includes a decoration part along a lower side surface of the cake, the fixing frame may be reversed such that the decoration part is positioned to correspond to the receiving groove to prevent the fixing frame makes contact with the decoration part.

In an example embodiment, the fixing frame may further include a receiving groove formed along a lower side of the inner side portion, wherein in case that the cake includes a decoration part along a lower side surface of the cake, the decoration part is positioned to correspond to the receiving groove to prevent the fixing frame makes contact with the decoration part.

In an example embodiment, the inner side portion, the outer side portion and the connecting portion may define an airbag into which air is injected.

In an example embodiment, the fixing frame may have a hollow surrounded by the inner side portion, the outer side portion and the connecting portion to make a lower surface open, thereby defining a space for accommodating an ice pack for cooling the cake is accommodated in.

According to one aspect of the present invention, a cake packaging structure includes a pedestal configured to support a lower surface of a cake, a box configured to receive the cake while being supported by the pedestal and a fixing frame provided between a side surface of the cake and an inner side surface of the box and to support the side surface of the cake so as to prevent the cake from moving in the box, wherein the fixing frame includes an inner side portion having a shape corresponding to that of a side surface of the cake supported on the pedestal to be configured to support the side surface of the cake, an outer side portion having a shape corresponding to that of an inner side surface of the box for receiving the cake supported by the pedestal to be configured to support an inner side surface of the box and a connecting portion configured to connect an upper end of the inner side portion and an upper end of the outer side portion with each other.

In an example embodiment, the fixing frame may have a hollow to make a lower surface thereof open, thereby forming a space for accommodating an ice pack for cooling the cake is accommodated in.

In an example embodiment, the fixing frame may include at least one holding groove being formed on the inner side portion or the outer side portion and extending vertically for inserting the fixing frame into the box and extracting the fixing frame from the box.

In an example embodiment, the inner side portion or the outer side portion may be inclined to have a horizontal width narrowing toward the connecting portion such that a plurality of fixing frames is vertically stacked to make entire contact with each other when the fixing frames are stored.

In an example embodiment, the fixing frame may be divided into a plurality of fixing parts having a size identical to each other.

In an example embodiment, the fixing frame may include a receiving groove formed along an upper side of the inner side portion, wherein in case that the cake includes a decoration part along a lower side surface of the cake, the fixing frame is reversed such that the decoration part is positioned to correspond to the receiving groove to prevent the fixing frame makes contact with the decoration part.

In an example embodiment, the fixing frame may include a receiving groove formed along a lower side of the inner side portion, wherein in case that the cake includes a decoration part along a lower side surface of the cake, the decoration part is positioned to correspond to the receiving groove to prevent the fixing frame makes contact with the decoration part.

In an example embodiment, the fixing frame may include an airbag into which air is injected.

In an example embodiment, the cake packaging structure may further include a strip belt surrounding the side surface of the cake to prevent the fixing frame from making contact with the side surface of the cake.

In an example embodiment, the cake packaging structure may further include a fixing member inserted through the lower surface of the cake into the cake to fix the cake to the pedestal.

According to some example embodiments of the present invention, the fixing frame supports the side surface of the cake. Therefore, even if a vibration or an impact occurs during transportation or delivery of the cake, the cake may be prevented from moving in the box and the cake may be stably fixed.

The fixing frame has a receiving groove along an upper end or a lower side end for supporting the cake, and the fixing frame is disposed such that the decoration part is located in the receiving groove when the decoration part is formed along a lower side of the cake. Therefore, it is possible to prevent the fixing frame from coming into contact with the decoration part, thereby preventing the decoration part from being damaged.

Further, the fixing frame has a hollow and the lower surface portion thereof may be opened. Therefore, a weight of the fixing frame may be reduced, and the fixing frame may be vertically stacked and stored.

Furthermore, the fixing frame may be divided into a plurality of fixing parts so as to have the same shape. Since the fixed frame is equally divided, a size of each of the fixing parts may be reduced. Since the fixing parts have the shape identical to each other, the fixing parts may be vertically stacked even if the fixing frame is divided.

Since the fixing frame has the holding grooves, the fixing frame may be conveniently inserted between the box and the cake using gripping grooves, or may be discharged from between the box and the cake.

The cake packing structure according to the present invention is provided with a strip belt surrounding the side surface of the cake, so that the fixing frame may be prevented from being in direct contact with the side surface of the cake. Therefore, it is possible to prevent cream or the like on the surface of the cake from being stuck on the fixing frame.

BRIEF DESCRIPTION OF THE DRAWINGS

The above and other features and advantages of the present invention will become more apparent by describing in detailed exemplary embodiments thereof with reference to the accompanying drawings, in which.

DESCRIPTION OF THE EMBODIMENTS

Figure 1:
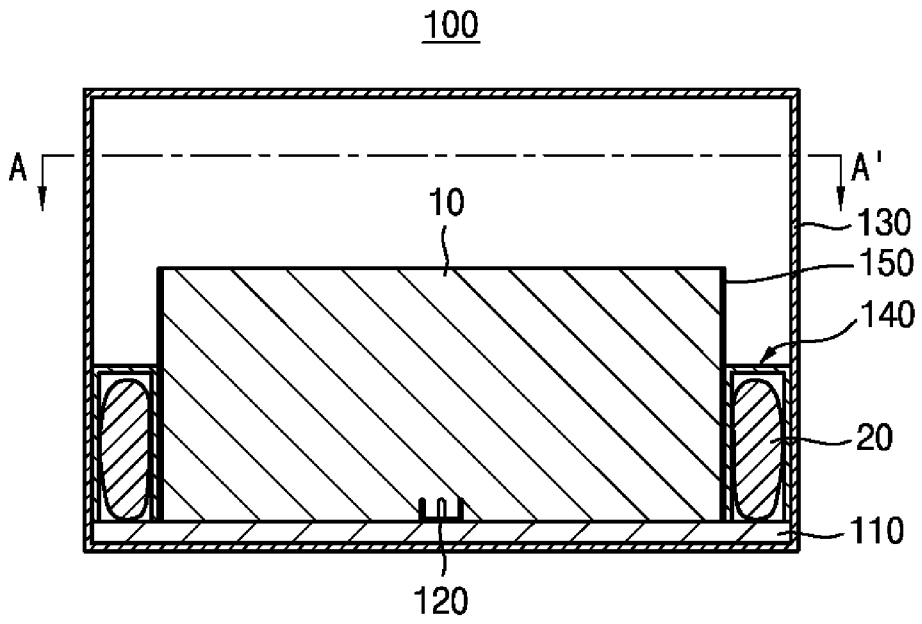
FIG. 1 is a side cross sectional view illustrating a cake packaging structure in accordance with an example embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the sizes and relative sizes of layers and regions may be exaggerated for clarity.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
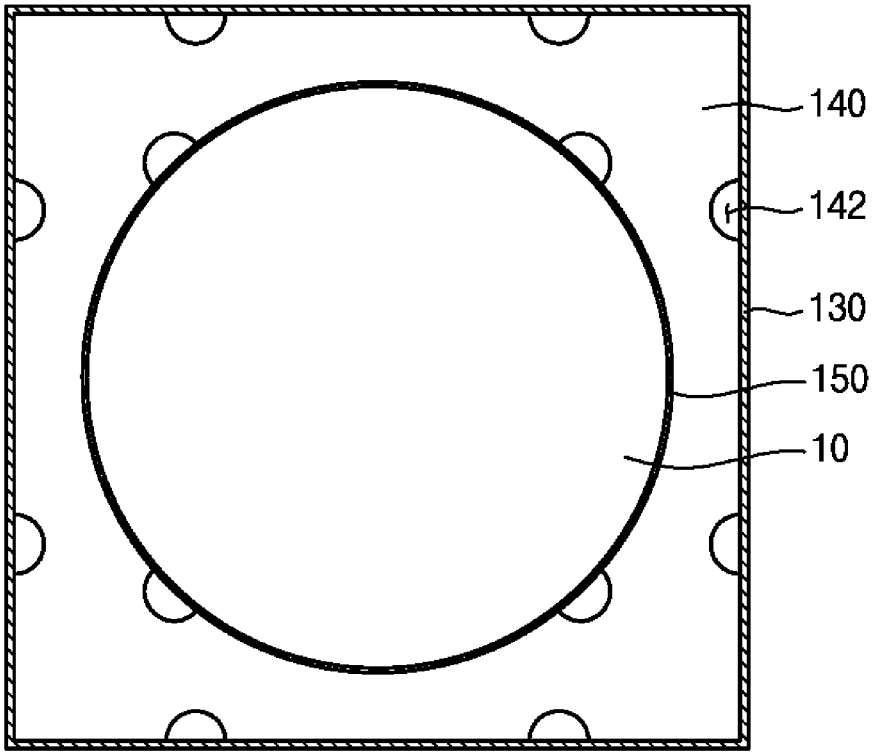
FIG. 2 is a cross sectional view taken along a line A-A' in FIG. 1.
Figure 3:
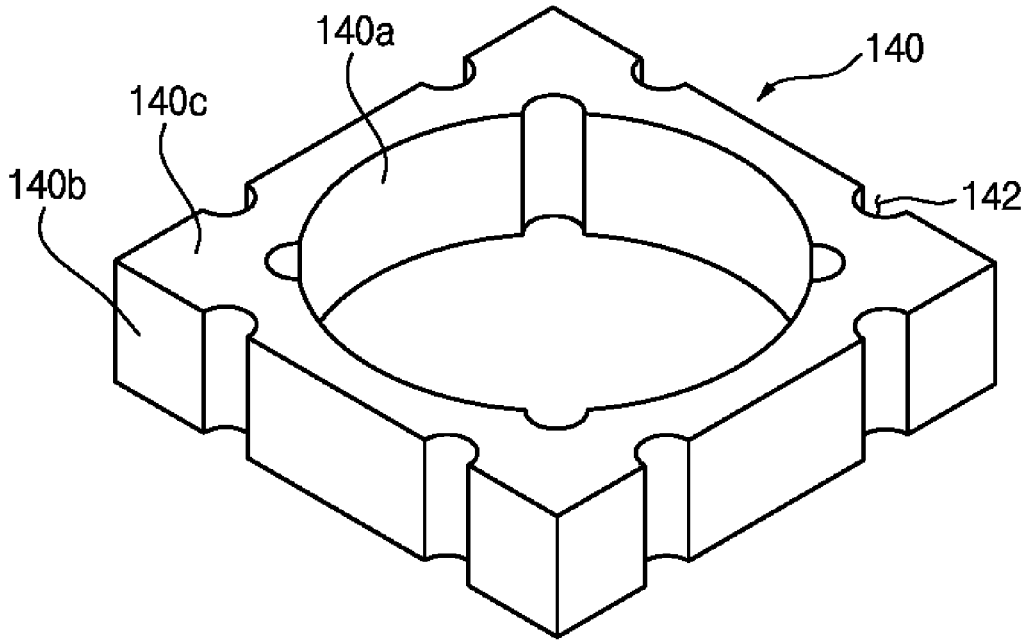
FIG. 3 is a perspective view illustrating a fixing frame in FIG. 1.

FIG. 1 is a side cross sectional view illustrating a cake packaging structure in accordance with an example embodiment of the present invention. FIG. 2 is a cross sectional view taken along a line A-A' in FIG. 1. FIG. 3 is a perspective view illustrating a fixing frame in FIG. 1.

Referring to FIGS. 1 to 3, a cake packing structure 100 in accordance with an example embodiment of the present invention includes a pedestal 110, a fixing member 120, a box 130 and a fixing frame 140.

The pedestal 110 supports a lower surface of a cake 10. The cake 10 may be manufactured using rice or wheat, etc. The pedestal 110 may have a shape such as a rectangular plate shape, a disc plate shape, etc. The pedestal 110 may have a size identical to that of the cake 10 to stably support the cake 10. For example, the cake 10 has a cylindrical shape generally. Alternatively, the cake 10 has a rectangular column shape In an example embodiment, the pedestal 110 may support a bread or the like having a columnar shape or a rectangular column shape as well as the cake 10. Thus, the cake packaging structure 100 may be used to package the bread as well as the cake 10.

The fixing member 120 is fixed to a central portion of an upper surface of the pedestal 110. The fixing member 120 is inserted into the cake 10 through a lower surface of the cake 10 under the state that the fixing member 120 is fixed to the pedestal 110. Therefore, the fixing member 120 may fix the cake 10 to the pedestal 110, and may prevent the cake 10 from moving horizontally move on the pedestal 110.

The box 130 receives the cake 10 of being supported by the pedestal 110. The horizontal cross-sectional shape of the box 130 has a shape corresponding to the shape of the pedestal 110. For example, the box 130 has a substantially hollowed hexahedral shape, a cylindrical shape, and the like. The box 130 may be open from its side or open from its top surface to provide a space for receive the cake 10. For example, the box 130 is made of a paper material, a plastic material, a styrofoam material, or the like.

Meanwhile, the size of the pedestal 110 may be substantially the same as that of the box 130. Since a side surface of the pedestal 110 makes close contact with an inner side surface of the box 130, the pedestal 110 may be prevented from horizontally moving in the box 130.

The fixing frame 140 is provided between a side surface of the cake 10 and the inner side surface of the box 130. The fixing frame 140 may horizontally support the side surface of the cake 10 by making contact with the inner side surface of the box 130 and surrounding the side surface of cake 10. Therefore, the fixing frame 140 can prevent the cake 10 from moving horizontally in the box 130.

The fixing frame 140 may have a hollow shape and a lower surface portion thereof may be opened. Therefore, a weight of the fixing frame 140 may be reduced, and a plurality of the fixing frame 140 may be vertically stacked and stored with inserting another fixing frame into an open lower surface portion of one fixing frame. Alternatively, the fixing frame 140 may have a lower surface portion close.

The fixing frame 140 may be made of synthetic resin such as plastic, paper or the like.

In particular, the fixing frame 140 may include an inner side portion 140*a*, an outer side portion 140*b*, and a connection portion 140*c*.

The inner side portion 140*a* has a shape corresponding to the side surface of the cake 10 and makes contact with the side surface of the cake 10. When the cake 10 has the cylindrical shape, the horizontal section of the inner side portion 140*a* has a circular shape, and when the cake 10 has the rectangular column shape, the horizontal section of the inner section 140*a* has a rectangular shape.

The outer side portion 140*b* has a shape corresponding to that of the inner side surface of the box 130. The outer side portion 140*b* makes contact with the inner side surface of the box 130 to horizontally support the fixing frame 140 from the box 130. When the box 130 has the hexahedron shape, the horizontal section of the outer side portion 140*b* has a rectangular shape. When the box 130 has the cylindrical shape, the horizontal section of the outer side portion 140*b* has a circular shape.

The connection portion 140*c* connects the inner side portion 140*a* and the outer side portion 140*b* with each other. For example, the connection portion 140*c* may connect an upper end of the inner side portion 140*a* and an upper end of the outer side portion 140*b* with each other.

The fixing frame 140 may have an inner space defined by the inner side portion 140*a*, the outer side portion 140*b* and the connection portion 140*c*. An ice pack 20 can be accommodated in the inner space of the fixing frame 140. The ice pack 20 may include dry ice, ice, and the like.

Since the ice pack 20 may cool the cake 10 to keep the cake 10 at a relatively low temperature, the cake 10 may be prevented from being damaged or melted owing to the fixing frame 140 and the ice pack 20, while the cake 10 is transported or delivered.

Also, since the ice pack 20 is accommodated in the inner space of the fixing frame 140, additional space for accommodating the ice pack 20 may not be required.

When the fixing frame 140 makes contact with the inner side surface of the cake 10 and the inner side surface of the box 130, spaces between the fixing frame 140 and the cake 10, and between the fixing frame 140 and the box 130 may be relatively narrow such that the fixing frame 140 may be difficult to be inserted or discharged from the box 130.

The fixing frame 140 has a plurality of holding grooves 142 which extend in a vertical direction on at least one of the inner side portion 140*a* or at least one of the outer side portion 140*b*. The fixing frame 140 may be easily picked up using the holding groove 142 and then, may be inserted between the cake 10 and the box 130 or may be discharged from between the cake 10 and the box 130.

Although not shown in detail, the inner side portion 140*a* and the outer side portion 140*b*, which define side surfaces of the fixing frame 140, may be inclined at a certain angle. For example, the inner side portion 140*a* and the outer side portion 140*b* may be inclined so that the distance between the inner side portion 140*a* and the outer side portion 140*b* becomes narrower and narrower toward the connection portion 140*c*. That is, the inner side portion 140*a* and the outer side portion 140*b* may be inclined inwardly toward the connection portion 140*c*. Although it is above-described that both the inner side portion 140*a* and the outer side portion 140*b* are inclined, either the inner side portion 140*a* or the outer side portion 140*b* may be inclined. Further, a plurality of the fixing frames may be vertically stacked by inserting another fixing frame 140 into the open lower surface of one fixing frame 140, when storing the plurality of the fixing frames 140 at an inventory or a store, such that a total volume of the plurality of the fixing frame 140 occupying the inventory or the store may be minimized.

Meanwhile, the fixing frame 140 may be made of a synthetic resin material such as vinyl. The fixing frame 140 may include an air bag into which air is injected. That is, the inner side portion 140*a*, the outer side portion 140*b*, and the connection portion 140*c* may define the airbag.

For example, the fixing frame 140 may be sealed with the air injected therein. As another example, the fixing frame 140 may be injected or discharged through a separate injection port.

Meanwhile, the fixing frame 140 may be reversed to make the lower surface portion open upwardly such that the ice pack 20 may be easily accommodated in the inner space of the fixing frame 140.

Figure 4:
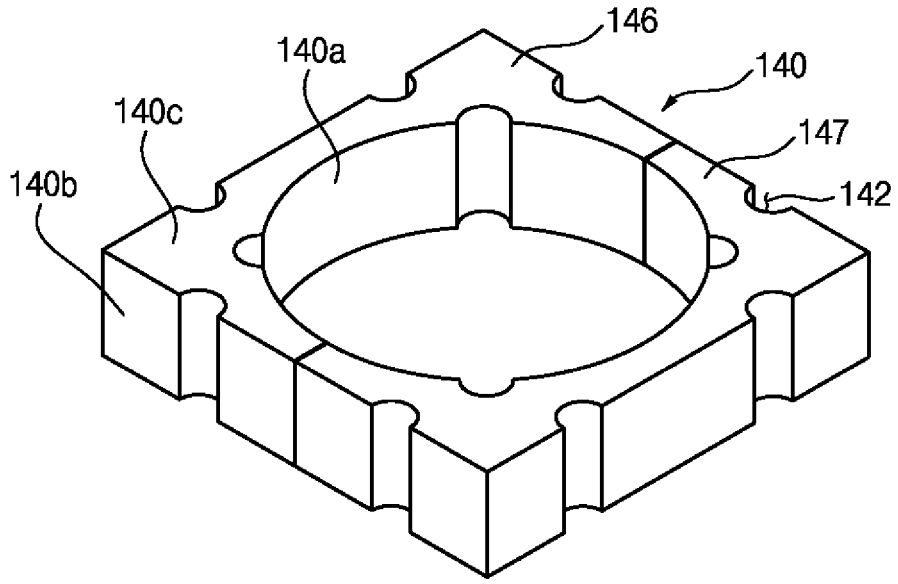
FIG. 4 is a perspective view illustrating a fixing frame in accordance with an example of the present invention.

FIG. 4 is a perspective view illustrating a fixing frame in accordance with an example of the present invention.

Referring to FIG. 4, a fixing frame 140 in accordance with an example of the present invention may include a plurality of fixing parts 146 and 147 having shapes identical to each other. For example, the fixing frame 140 shown in FIG. 3 is bisected to be divided to have two fixing parts 146 and 147 such two fixing parts 146 and 147 have equal shape and equal size. Alternatively the fixing frame 140 as shown in FIG. 3 may be divided into four equal parts or eight equal parts, although not shown.

Although not shown in detail, the connecting portion 140*c* may be extended to cover a divided portion of the fixing frame 140 such that each of the fixing part 146 and 147 may be enclosed. Therefore, the connecting portion 140*c* may supplement a strength of the fixing frame 140, even though the divided portion may weaken the fixing frame 140.

Since the fixing frame 140 is equally divided, a size of each of the fixing parts 146 and 147 which consists of the fixing frame 140 may be reduced. In addition, since the fixing parts included in the fixing frame 140 have the same shape, the fixing parts may be easily and vertically stacked. When the inner side portion 140*a* and the outer side portion 140*b* are inclined, the fixing parts 146 and 147 may be vertically stacked to save a stack space occupied by a plurality of the fixing parts.

Meanwhile, the fixing frame 140 may be divided into a plurality of different shapes.

Figure 5:
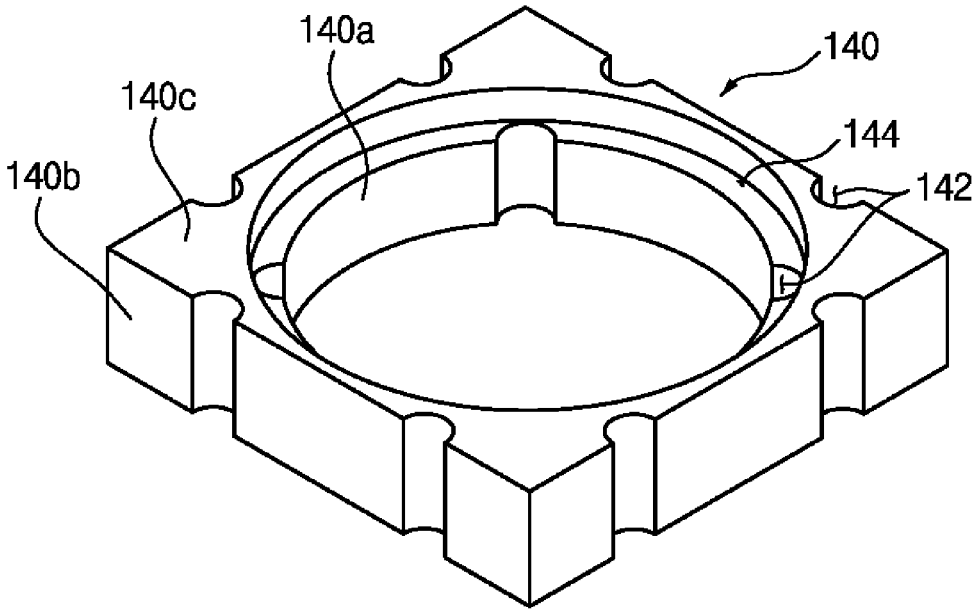
FIG. 5 is a perspective view illustrating a fixing frame in accordance with an example of the present invention.
Figure 6:
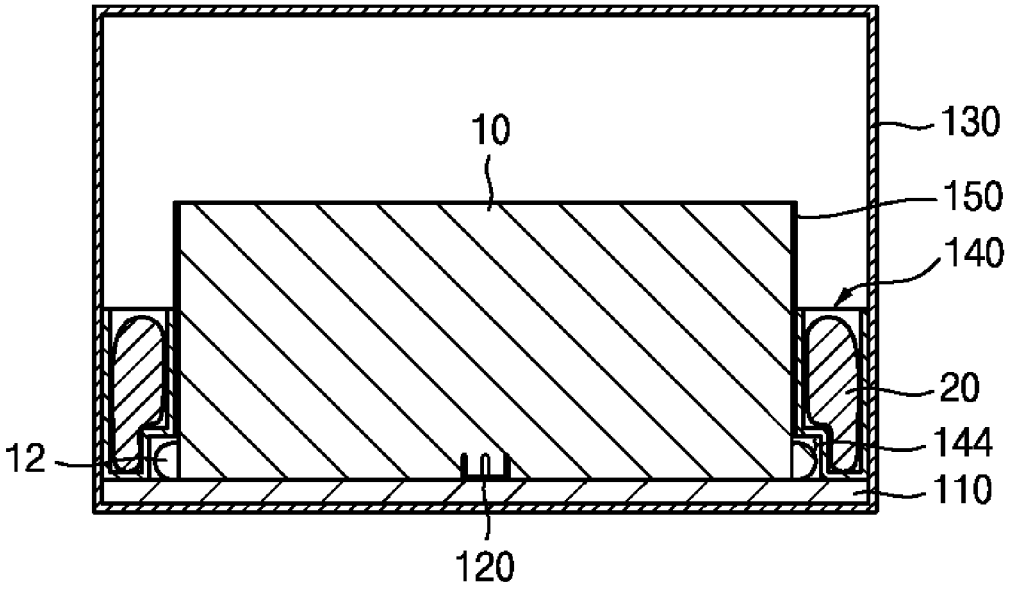
FIG. 6 is a side cross sectional view illustrating a cake packing structure including the cake fixing frame in FIG. 5.

FIG. 5 is a perspective view illustrating a fixing frame in accordance with an example of the present invention. FIG. 6 is a side cross sectional view illustrating a cake packing structure including the cake fixing frame in FIG. 5.

Referring to FIGS. 5 and 6, a fixing frame 140 in accordance with an example of the present invention may be provided with a receiving groove 144 along a side of the fixing frame 140. That is, the receiving groove 144 may be formed along the upper end of the inner side portion 140*a*. The receiving groove 144 may be formed by bending the upper end portion of the inner side portion 140*a*.

When the cake 10 does not include a decoration portion 12 along a lower end thereof, the fixing frame 140 may be inserted into a space between an inner side portion of the box 130 and a side of the cake 10 to support the cake 10.

When the cake 10 includes a decoration portion 12 along a lower end thereof, the fixing frame 140 may be vertically inverted, and then may be inserted into the space between an inner side portion of the box 130 and a side of the cake 10. Thus, the receiving groove 144 may be positioned for receiving the decoration portion 12 of the cake 10. As a result, the fixing frame 140 may be prevented from making contact with the decoration portion 12 of the cake 10, thereby preventing the decoration portion 12 from being damaged.

Meanwhile, the connecting portion 140*c* connects the upper end of the inner side portion 140*a* and the upper end of the outer side portion 140*b* so that a plurality of fixing frame 140 may be stacked thereon, even if the receiving groove 144 is provided along the upper end of the inner side portion 140*a*.

Figure 7:
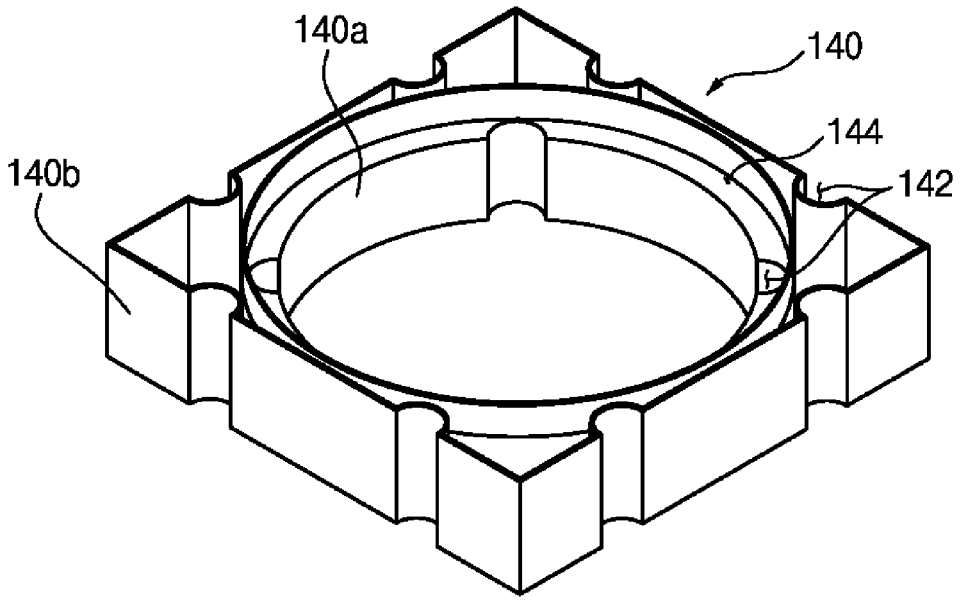
FIG. 7 is a rear perspective view illustrating a fixing frame in an example embodiment of the present invention.
Figure 8:
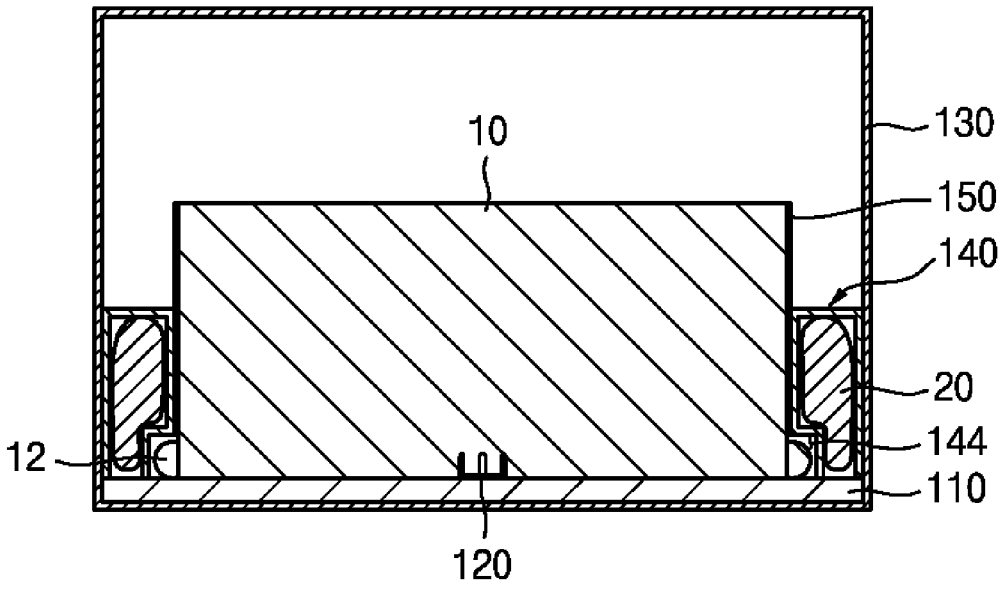
FIG. 8 a side cross sectional view illustrating a cake packing structure including the fixing frame in FIG. 7.

FIG. 7 is a rear perspective view illustrating a fixing frame in an example embodiment of the present invention. FIG. 8 a side cross sectional view illustrating a cake packing structure including the fixing frame in FIG. 7.

Referring to FIGS. 7 and 8, a fixing frame 140 in accordance with an example embodiment may be provided with a receiving groove 144 along a lower side surface of an inner side portion 140*a*. The receiving groove 144 may be formed by bending the lower end of the inner side portion 140*a*.

A decoration part 12 may be received in the receiving groove 144 when the decoration part 12 is provided along a lower end of the cake 10. Therefore, the fixing frame 140 may be prevented from making contact with the decoration part 12, thereby preventing the decoration part 12 from being damaged.

The connecting portion 140*c* connects the upper end of the inner portion 140*a* and the upper end of the outer portion 140*b*

Although not shown in detail, the fixing frame 140 shown in FIGS. 5 to 8 may be equally divided into a plurality of fixing parts so as to have the same shape. Therefore, a size of the fixing parts, which are to be assembled into the fixing frame 140, may be reduced, and the plurality of the fixing parts may be easily stacked.

Referring again to FIGS. 1 to 3, a strip belt 150 is provided to surround the side surface of the cake 10.

When the decoration part 12 is formed along the lower end of the cake 10, the strip belt 150 may be provided to surround a side of the cake 10 except for a position where the decoration part 12 is present.

The strip belt 150 may prevent the fixing frame 140 from making contact with the side surface of the cake 10. Thus, cream may be prevented from adhering to the fixing frame 140, even if the cake 10 is a whipped cream cake.

According to example embodiments of the present invention, since the cake packing structure according to the present invention supports the cake using the fixing frame, the cake may be prevented from moving in the box and the cake may be stably fixed.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of the present invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A fixing frame comprising:

an inner side portion having a shape corresponding to that of a side surface of a cake supported on a pedestal, the inner side portion being configured to support the side surface of the cake;

an outer side portion having a shape corresponding to that of an inner side surface of a box for receiving the cake supported by the pedestal, the outer side portion configured to support an inner side surface of the box;

a connecting portion configured to connect an upper end of the inner side portion and an upper end of the outer side portion with each other; and a receiving groove formed along the inner side portion, wherein the fixing frame is to be provided between the side surface of the cake and the inner side surface of the box to support the side surface of the cake to prevent the cake from moving in the box.

2. The fixing frame of claim 1, further comprising at least one holding groove being formed on the inner side portion or the outer side portion and extending vertically for easily inserting the fixing frame into the box and easily extracting the fixing frame from the box.

3. The fixing frame of claim 1, wherein at least one of the inner side portion and the outer side portion is inclined toward the other such that a plurality of fixing frames is vertically stacked such that the plurality of fixing frames make entire contact with one another.

4. The fixing frame of claim 1, wherein the fixing frame includes a plurality of fixing parts where the fixing parts are identical in size to each other.

5. The fixing frame of claim 1, wherein the receiving groove is formed along an upper side of the inner side portion, wherein in case that the cake includes a decoration part along a lower side surface of the cake, the fixing frame is configured to be invertible such that the decoration part of the cake is positioned to correspond to the receiving groove to prevent the fixing frame from making contact with the decoration part.

6. The fixing frame of claim 1, wherein the receiving groove is formed along a lower side of the inner side portion, wherein in case that the cake includes a decoration part along a lower side surface of the cake, the decoration part is positioned to correspond to the receiving groove to prevent the fixing frame makes contact with the decoration part.

7. The fixing frame of claim 1, wherein the inner side portion, the outer side portion and the connecting portion define an airbag into which air is injected.

8. The fixing frame of claim 1, wherein the fixing frame has a hollow surrounded by the inner side portion, the outer side portion and the connecting portion to make a lower surface open, thereby defining a space for accommodating an ice pack for cooling the cake is accommodated in.

9. A cake packaging structure comprising:

a pedestal configured to support a lower surface of a cake;

a box configured to receive the cake while being supported by the pedestal; and a fixing frame provided between a side surface of the cake and an inner side surface of the box and to support the side surface of the cake so as to prevent the cake from moving in the box, wherein the fixing frame comprises:

an inner side portion having a shape corresponding to that of a side surface of the cake supported on the pedestal, the inner side portion being configured to support the side surface of the cake;

an outer side portion having a shape corresponding to that of an inner side surface of the box for receiving the cake supported by the pedestal, the outer side portion be configured to support an inner side surface of the box;

a connecting portion configured to connect an upper end of the inner side portion and an upper end of the outer side portion with each other; and a receiving groove formed along the inner side portion.

10. The cake packaging structure of claim 9, wherein the fixing frame has a hollow to make a lower surface thereof open, thereby forming a space for accommodating an ice pack for cooling the cake is accommodated in.

11. The cake packaging structure of claim 9, wherein the fixing frame comprises at least one holding groove being formed on the inner side portion or the outer side portion and extending vertically for inserting the fixing frame into the box and extracting the fixing frame from the box.

12. The cake packaging structure of claim 9, wherein the inner side portion or the outer side portion is inclined to have a horizontal width narrowing toward the connecting portion such that a plurality of fixing frames is vertically stacked to make entire contact with one another when the plurality of fixing frames are stored.

13. The cake packaging structure of claim 9, wherein the fixing frame is divided into a plurality of fixing parts where the fixing parts are identical in size to each other.

14. The cake packaging structure of claim 9, wherein the receiving groove is formed along an upper side of the inner side portion, wherein in case that the cake includes a decoration part along a lower side surface of the cake, the fixing frame is configured to be invertible such that the decoration part of the cake is positioned to correspond to the receiving groove to prevent the fixing frame from making contact with the decoration part.

15. The cake packaging structure of claim 9, wherein the receiving groove is formed along a lower side of the inner side portion, wherein in case that the cake includes a decoration part along a lower side surface of the cake, the decoration part of the cake is positioned to correspond to the receiving groove to prevent the fixing frame from making contact with the decoration part.

16. The cake packaging structure of claim 9, wherein the fixing frame includes an airbag into which air is injected.

17. The cake packaging structure of claim 9, further comprising a strip belt surrounding the side surface of the cake to prevent the fixing frame from making contact with the side surface of the cake.

18. The cake packaging structure of claim 9, further comprising a fixing member inserted through the lower surface of the cake into the cake to fix the cake to the pedestal.

* * * * *